US008196232B2

(12) United States Patent
Van Herp et al.

(10) Patent No.: US 8,196,232 B2
(45) Date of Patent: Jun. 12, 2012

(54) EXHAUST UNIT FOR A TOILET BOWL

(75) Inventors: Petrus Joannes Wilhelmus Van Herp, Tilburg (NL); Johannes Hermanus Petrus Maria Oonk, Tilburg (NL); Tijmen Karel Jan Boogers, Tilburg (NL)

(73) Assignee: Trivio Invest B.V., Tilburg (NL)

( * ) Notice: Subject to any disclaimer, the term of this patent is extended or adjusted under 35 U.S.C. 154(b) by 1477 days.

(21) Appl. No.: 11/568,304

(22) PCT Filed: Apr. 26, 2005

(86) PCT No.: PCT/NL2005/000313

§ 371 (c)(1),
(2), (4) Date: Jan. 25, 2007

(87) PCT Pub. No.: WO2005/108687

PCT Pub. Date: Nov. 17, 2005

(65) Prior Publication Data

US 2007/0169257 A1 Jul. 26, 2007

(30) Foreign Application Priority Data

Apr. 26, 2004 (NL) ..... 1026037

(51) Int. Cl.
*E03D 9/05* (2006.01)
*E03D 11/00* (2006.01)

(52) U.S. Cl. ..... 4/349; 4/347; 4/350; 4/352; 4/306; 4/252.2; 4/226.1; 4/224

(58) Field of Classification Search ..... 4/306, 347, 4/349, 348, 350, 351, 352, 252.2, 252.3, 4/226.1, 224
See application file for complete search history.

(56) References Cited

U.S. PATENT DOCUMENTS 1,691,359 A * 11/1928 Pulkinghorn ..... 4/226.1
3,648,935 A * 3/1972 Waldrum ..... 239/659
4,212,089 A 7/1980 Lindauer
(Continued)

FOREIGN PATENT DOCUMENTS

CH 385352 A 12/1964
(Continued)

OTHER PUBLICATIONS

International Search Report for PCT/NL2005/000313.

*Primary Examiner* — Gregory Huson
*Assistant Examiner* — Bradley Oliver
(74) *Attorney, Agent, or Firm* — Ryan A. Schneider, Esq.; Troutman Sanders LLP

(57) ABSTRACT

An exhaust unit for a hanging toilet bowl is described, and includes a house with a back wall and a front wall, two exhaust coupling tubes extending in the house from the front wall to the back wall and having a first end projecting outside the house back wall. The first end of a second exhaust coupling tube can have a diameter that is larger than the diameter of the first end of a first exhaust coupling tube. At its second end, the first exhaust coupling tube can be provided with a sealing ring arranged in a groove-shaped recess of the inner wall. At its second end, the second exhaust coupling tube can provided with a sealing ring arranged in a groove-shaped recess of the inner wall.

40 Claims, 10 Drawing Sheets

U.S. PATENT DOCUMENTS

| | | | | | |
|---|---|---|---|---|---|
| 4,963,780 | A | * | 10/1990 | Hochstrasser | 310/104 |
| 5,347,661 | A | * | 9/1994 | Fly et al. | 4/226.1 |
| 5,367,716 | A | * | 11/1994 | Huang | 4/228.1 |
| 6,295,656 | B1 | * | 10/2001 | Tillen | 4/216 |
| 6,413,476 | B1 | * | 7/2002 | Barnhart | 422/125 |
| 6,588,026 | B2 | * | 7/2003 | Meier et al. | 4/226.1 |

FOREIGN PATENT DOCUMENTS

| | | | | |
|---|---|---|---|---|
| DE | 4311066 | A1 | * | 9/1994 |
| DE | 29919800 | U1 | | 2/2000 |
| FR | 2672621 | A1 | * | 8/1992 |
| JP | 06002353 | A | * | 1/1994 |

* cited by examiner

EXHAUST UNIT FOR A TOILET BOWL

BENEFIT CLAIMS

This application is a US National Stage of International Application No. PCT/NL2005/000313, filed 26 Apr. 2005, which claims the benefit of NL 1026037, filed 26 Apr. 2004.

The invention relates in general to the area of toilet bowls, urinals, and the like. As regards to function, a toilet bowl and a urinal are similar; in fact, one can call a urinal also a toilet bowl in the broad meaning of the word "toilet bowl", wherein a toilet bowl in the narrow meaning of the word is a version provided with a seat, while a urinal is considered a version of a toilet bowl in the broad meaning of the word, but then without seat and with a different design. In de following, the phrase "toilet bowl" will be used in the broad meaning of the word; this applies especially to the claims. By way of example, the invention will be explained by describing a toilet bowl in the narrow meaning of the word.

During the normal use of a toilet bowl, it is not unusual that unpleasant smells are released. This fact is commonly known, and several exhaust installations have already been designed for exhausting the unpleasantly smelling gases.

A particular type of exhaust system may be indicated as "room-exhaust": in the ceiling of the chamber where the toilet bowl is situated, an opening is made which communicates with the outside air by means of a tube in which a fan is arranged. The fan sucks air out of the room, and the sucked air is released to the outside world. Several disadvantages are associated with this known system.

A first disadvantage relates to the fact that the unpleasantly smelling gases are released to the outside world, where they may be smelled by people in the surrounding, which is unpleasant for those people.

A second disadvantage relates to the fact that the unpleasantly smelling gases are sucked from the inner space of the toilet bowl into the room, and pass the nose of the user of that toilet bowl on the way to the fan, so that this user is confronted more with the just produced gases.

A third disadvantage relates to the fact that such a system requires an infrastructural provision in the building. In a situation that such a system is absent, it costs a lot of work to add such a system.

Another type of exhaust will be indicated as "sewer exhaust". In such a system, the air sucked by the fan is blown away to a sewer tube, where the exhausted air causes less nuisance than in the outside air. Then also, the air could be sucked from the room, and the drawback associated with it could remain, but there are several systems of this type which suck the unpleasantly smelling gases straight from the inner space of the toilet bowl.

Many of the known systems of this type have as disadvantage that they also again require an infrastructural adaptation of the building concerned. There are also several systems known that do not require adaptation of the building concerned, but in such systems, the required air channels are usually integrated in the toilet bowl itself. This means that an adaptation is necessary of the construction of the toilet bowl, which is usually manufactured of porcelain or a similar material. This makes such toilet bowls relatively expensive. Moreover, with such a system it is not possible to be installed with an existing toilet bowl.

U.S. Pat. No. 5,386,594 describes an exhaust system of the "sewer exhaust" type, that may be installed with an existing toilet bowl, and that does not require adaptations of the toilet bowl or of the building. This known exhaust system is intended for a toilet bowl (in the narrow meaning of the word) of the standing type, i.e. a toilet bowl of which the bottom side is intended to rest on a floor, wherein flushing water flows away through the bottom side to a sewer pipe arranged in the floor. Further, it is a limiting factor that the known exhaust system is intended for a toilet bowl with a water reservoir standing on the edge of the bowl. The known exhaust system comprises a first coupling piece that is positioned between the toilet bowl and the water reservoir, and a second coupling piece that is positioned between the toilet bowl bottom side and the floor. Further, the known system comprises a system of pipes, as well as a fan, to be positioned beside and/or behind the toilet bowl, coupled with the two coupling pieces. Thus, this known system necessarily has a relatively large number of parts, which makes the installation of the system difficult.

The necessity to mount the system of pipes beside and behind the toilet bowl is undesired from an aesthetic and hygienic point of view. Also the coupling pieces under the water reservoir that stands on the edge of the bowl, and between the bowl and the floor form edges and cracks which are difficult to clean and therefore form a problem from a hygienic point of view.

For ergonomic reasons, the upper side of the toilet seat is arranged at a particular height. For children, this height will be lower than for adults. A disadvantage of the system as described in U.S. Pat. No. 5,386,594 is that the coupling piece under the toilet bowl has as a result that the entire toilet bowl rises almost 4 cm, which may be uncomfortable for the user. Moreover, this has as a result that the connection of the toilet bowl to the water supply, for filling the water reservoir, has to be adapted.

The air pipe between the two coupling pieces means that there is an open connection between the interior of the toilet bowl and the sewer. When the fan is standing still, undesired sewer vapours could reach the interior of the toilet bowl through said air pipe, which results in an unpleasant smelling of the toilet room at moments that the fan is switched off. In order to counteract this, in the system as described in U.S. Pat. No. 5,386,594, a gooseneck-shaped water trap is included in the pipe, as closure. Such a gooseneck-shaped water trap increases the complexity of the system. Moreover, during flushing of the toilet, the water will be sucked out of the gooseneck-shaped water trap; in order to refill the water, a separate filling pipe is needed between the water reservoir and the gooseneck, which further increases the complexity of the system. Further, when the exhaust system is out of use for a long time, the water in the gooseneck may dry up, whereby the closing function is cancelled and the sewer air can still reach the toilet room.

An object of the present invention is to cancel or reduce the said drawbacks.

In particular, the present invention aims at providing an exhaust system of the "sewer exhaust" type, which is suitable for application in toilet bowls of the hanging type, i.e. bowls of which the back side supports against a wall or the like while the bottom side is free from the floor.

More particularly, the present invention aims at providing an exhaust system which can be mounted more easily, which has a pretty or at least not disturbing appearance in aesthetic respect, and which is easily cleanable in hygienic respect.

According to an import aspect of the present invention, an exhaust unit is provided which comprises a house with a back wall and a front wall, substantially parallel to the back wall. Further, the unit comprises a first exhaust coupling tube and a second exhaust coupling tube, mutually extending parallel from the house front wall to the house back wall and projecting outside the house back wall, wherein the second exhaust coupling tube has a diameter that is larger than the diameter of the first exhaust coupling tube. Each exhaust coupling tube is provided with a sealing ring arranged in a groove-shaped recess of the inner wall, in order to thus be able to couple with the inlet and discharge tube, respectively, or extensions thereof, of a standard toilet bowl.

These and other aspects, features and advantages of the present invention will be further explained by the following description with reference to the drawings, in which same reference number indicate same or similar parts, and in which:

FIG. 1 schematically shows a side view of a conventional floating toilet bowl;

FIG. 2A schematically shows a cross section of a wall passage construction in a conventional floating toilet bowl;

FIG. 2B schematically shows a rear view of a conventional floating toilet bowl;

FIG. 3 schematically shows a cross section comparable to FIG. 2A of a wall passage construction in a floating toilet bowl according to the present invention;

FIG. 4 schematically shows a side view comparable to FIG. 1 of a floating toilet bowl according to the present invention;

FIG. 5 schematically shows a longitudinal section of an exhaust unit according to the present invention;

Figure 9A:
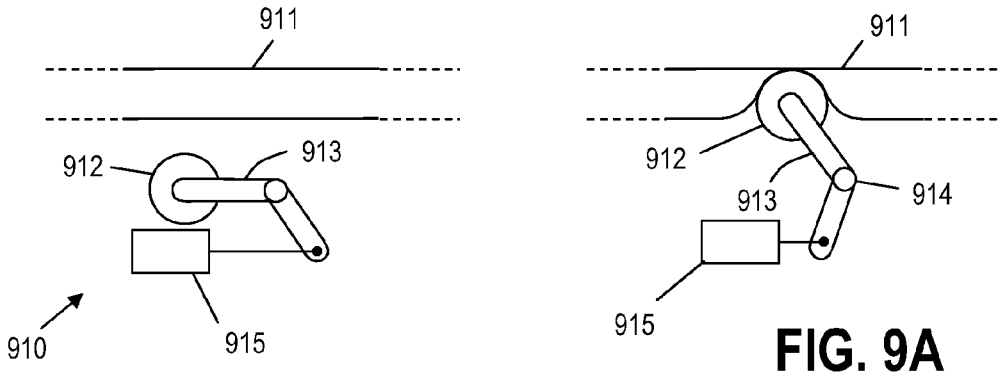
Figure 9B:
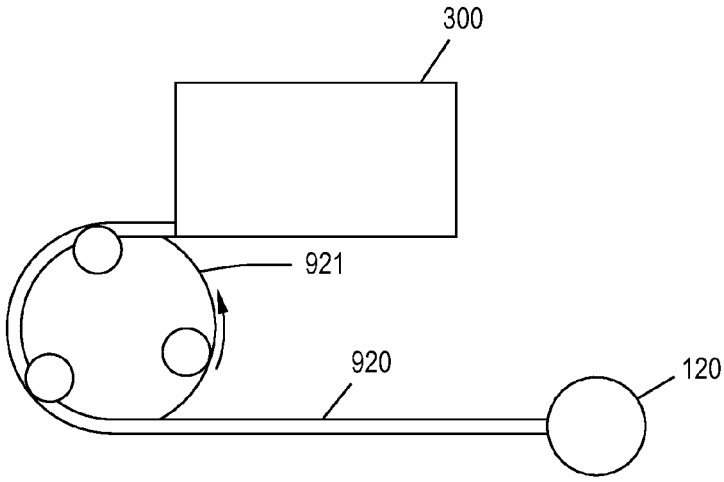
Figure 10:
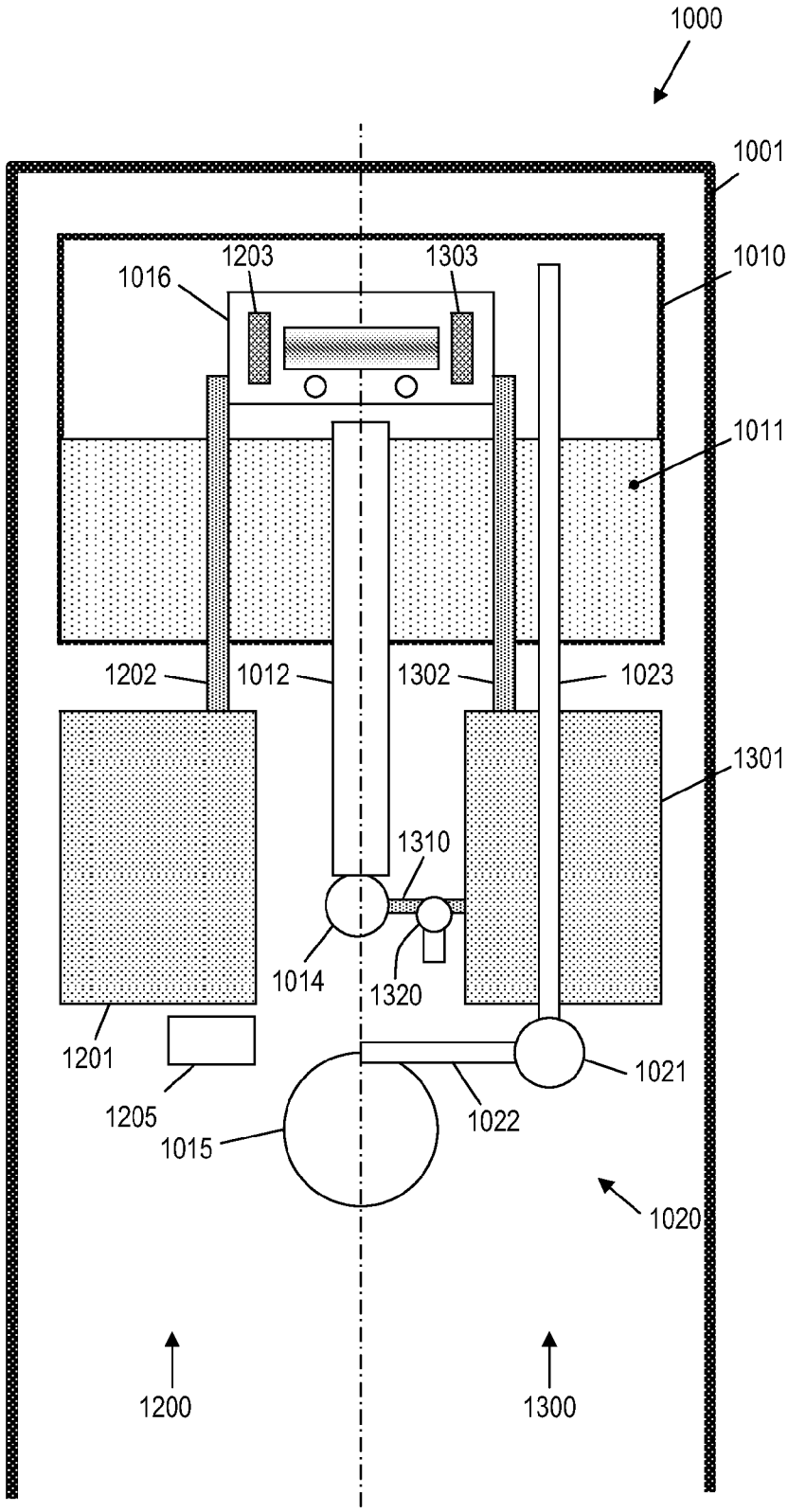

FIG. 9A schematically illustrates an embodiment of a valve which has no moving parts inside the channel to be closed;

FIG. 9B schematically illustrates dosing of cleaning fluid by means of a displacement pump;

FIG. 10 schematically shows a front view of a flushing unit adapted according to the present invention.

Figure 1:
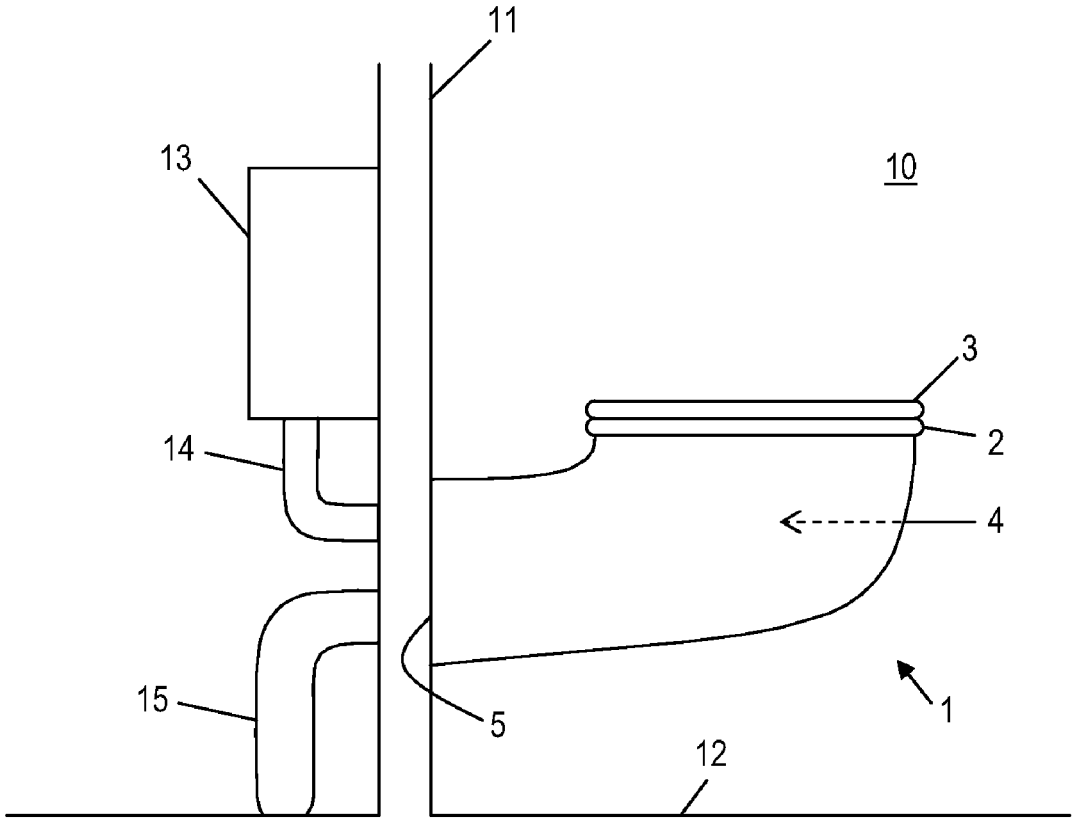
FIG. 1 PRIOR ART

FIG. 1 schematically shows a side view of a floating toilet bowl 1, with a pivotable seat 2, a pivotable cover 3, and an inner space 4; since toilet bowls are known per se, an extensive discussion thereof is superfluous. The toilet bowl 1 is placed in a room 10 with a wall 11 and a floor 12. The toilet bowl 1 has a rear edge 5 supporting against the wall 11. For the remainder, the toilet bowl 1 is free; more particularly, there is vertical space between the lowest point of the toilet bowl 1 and the floor 12: the toilet bowl 1 hangs on the wall 11, by means of attachment means known per se that are not shown for the sake of simplicity.

Behind the wall 11, a water reservoir 13 is attached that is provided with a water supply tube 14 at its bottom side. The water reservoir 13 is provided with a control panel mounted in the wall, which panel is not shown for the sake of simplicity. Further, a sewer pipe 15 is arranged behind the wall 11. The water reservoir 13 and the said tubes are not visible from the room 10. As will be explained in more detail later, the wall 11 has a first passage opening, through which the water supply tube 14 of the water reservoir 13 is connected to a water inlet gate of the toilet bowl 1, and a second passage opening, through which a water discharge gate of the toilet bowl 1 is connected to the sewer pipe 15.

Figure 2B:
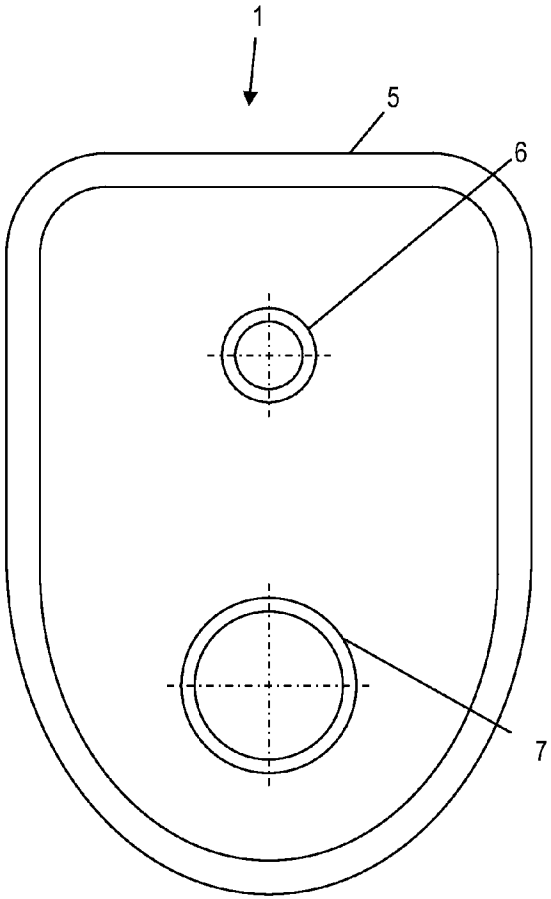
FIG. 2B PRIOR ART
Figure 2A:
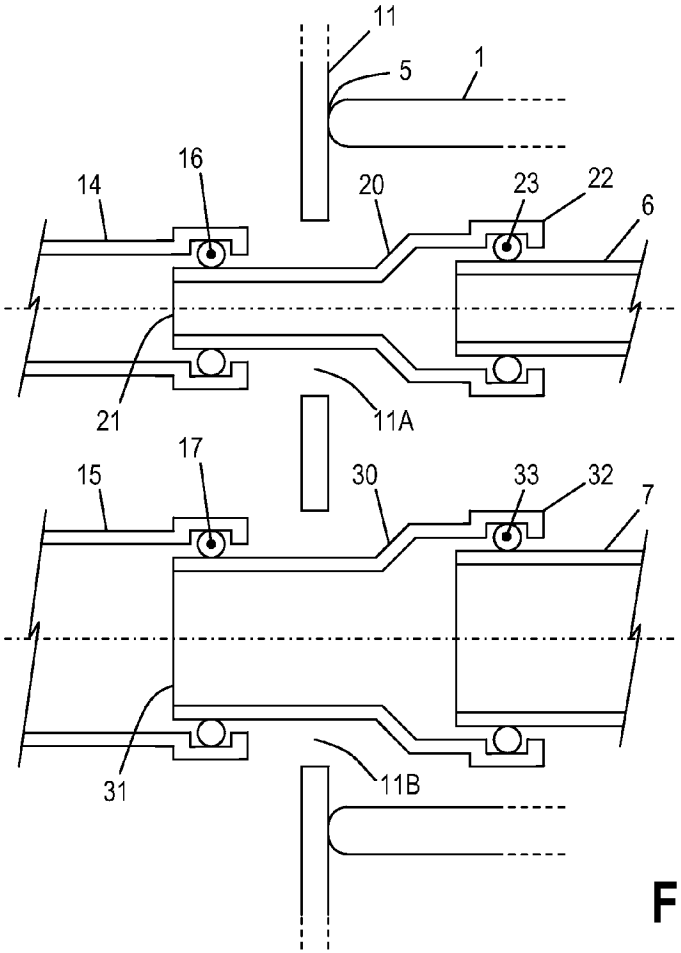
FIG. 2A PRIOR ART

FIG. 2A schematically shows a cross section of the wall 11 at the position of the passage openings 11A and 11B thereof, for a usual mounting situation of a usual toilet bowl of the hanging type, and FIG. 2B schematically shows a rear view of the toilet bowl 1.

The toilet bowl 1 has an inlet tube 6, of which the free end is connected to the water supply tube 14 of the water reservoir 13 by means of a first coupling tube 20 extending through the first passage opening 11A of the wall 11. The first coupling tube 20 has a first end 21 that is stuck into the free end of the water supply tube 14. The first end 21 of the first coupling tube 20 has an outer diameter that fits to the inner diameter of the water supply tube 14, wherein a first sealing ring 16, accommodated in an annular groove in the inner wall of the water supply tube 14, connects water-tightly to both the water supply tube 14 and the first coupling tube 20. The first coupling tube 20 has a second end 22 that receives the free end of the inlet tube 6 of the toilet bowl 1. The free end of the inlet tube 6 has an outer diameter that fits to the inner diameter of the second end 22 of the first coupling tube 20, wherein a second sealing ring 23, accommodated in an annular groove in the inner wall of the first coupling tube 20, connects water-tightly to both the inlet tube 6 and the first coupling tube 20.

The toilet bowl 1 has a discharge tube 7, of which the free end is connected to the sewer tube 15 by means of a second coupling tube 30 that extends through the second passage opening 11B of the wall 11. The second coupling tube 30 has a first end 31 that is stuck into the free entry end of the sewer tube 15. The first end 31 of the second coupling tube 30 has an outer diameter that fits to the inner diameter of the sewer tube 15, wherein a third sealing ring 17, accommodated in an annular groove in the inner wall of the sewer tube 15, connects water-tightly to both the sewer tube 15 and the second coupling tube 30. The second coupling tube 30 has a second end 32 that receives the free end of the discharge tube 7 of the toilet bowl 1. The free end of the discharge tube 7 has an outer diameter that fits to the inner diameter of the second end 32 of the second coupling tube 30, wherein a fourth sealing ring 33, accommodated in an annular groove in the inner wall of the second coupling tube 30, connects water-tightly to both the discharge tube 7 and the second coupling tube 30.

It is noted that, in mounted state, the rear edge 5 of the toilet bowl 1 supports against the wall 11 and hides the coupling tubes 20 and 30 from view.

Figure 3:
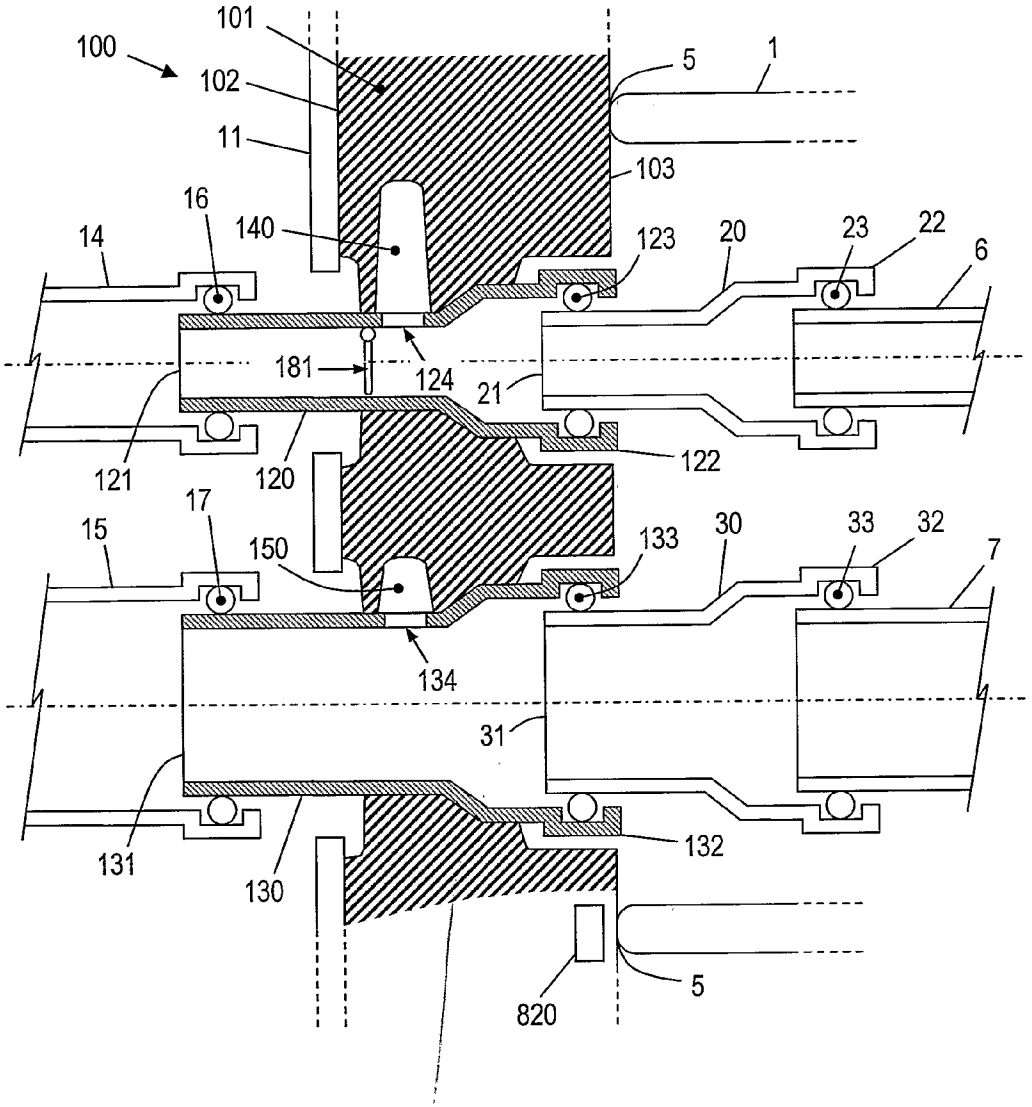
Figure 4:
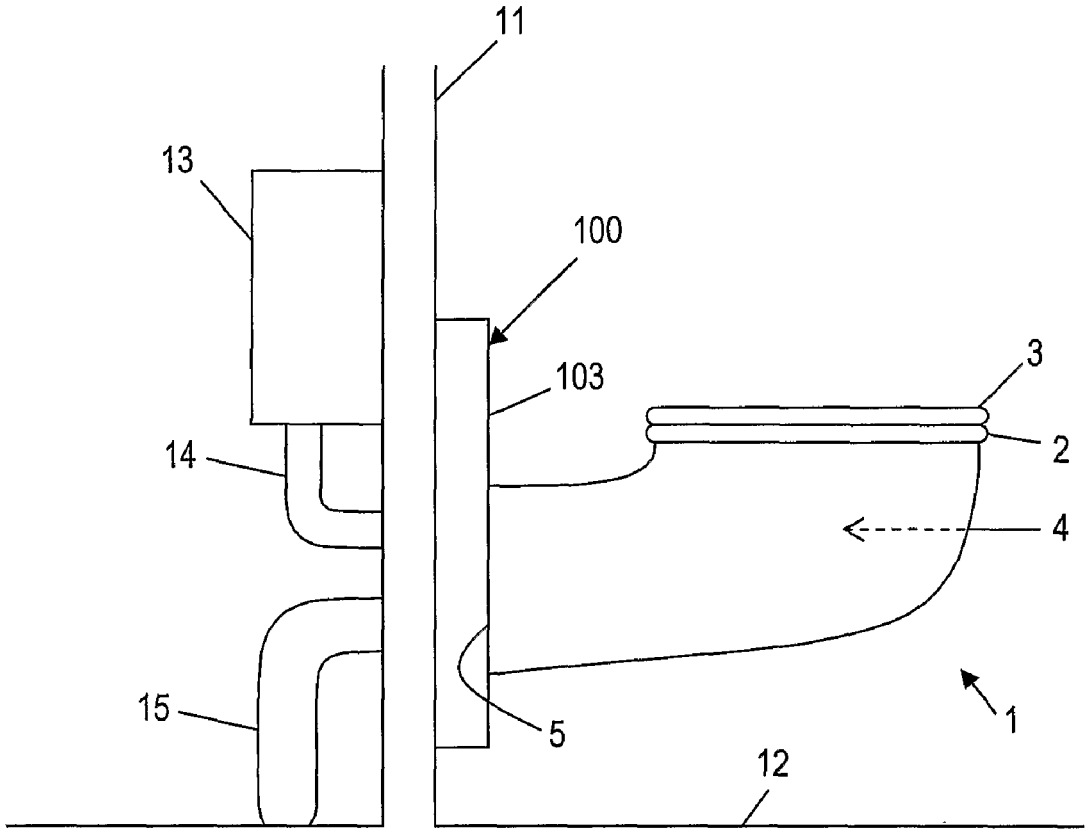

The present invention provides an exhaust unit 100, that can be applied to an existing toilet bowl 1, and is then mounted between that toilet bowl 1 and the wall 11. FIG. 3 is a schematic cross section, comparable to FIG. 2A, illustrating the situation then reached. The wall 11, with the water reservoir 13 positioned behind it, the water supply tube 14, and the sewer tube 15, are unchanged. An exhaust unit 100 according to the present invention is mounted against the wall 11. The exhaust unit 100 comprises a house 101 with a first exhaust coupling tube 120 and a second exhaust coupling tube 130. The two exhaust coupling tubes 120 and 130 are fixed relative to each other, with their centre lines substantially parallel, wherein the mutual distance between those two centre lines corresponds to the mutual distance between the centre lines of the inlet tube 6 and the discharge tube 7 of the toilet bowl 1. This distance is standardized, as well as the diameters of the inlet tube 6 and the discharge tube 7, as will be known to a person skilled in the art.

The house 101 has a rear wall 102, that contacts the wall 11 in the mounted state. The first exhaust coupling tube 120 has a first end 121 that projects outside the house rear wall 102, the outer diameter of which end 121 being adapted to the diameter of the first sealing ring 16 of the water supply tube 14. The second exhaust coupling tube 130 has a first end 131 that projects outside the house rear wall 102, the outer diameter of which end 131 being adapted to the diameter of the third sealing ring 17 of the sewer tube 15. The house 101 is mounted against the wall 11 in such a way that the exhaust coupling tubes 120 and 130 are aligned with the water supply tube 14 and the sewer tube 15, respectively. Further, the first end 121 of the first exhaust coupling tube 120 is inserted into the free end of the water supply tube 14, and the first end 131 of the second exhaust coupling tube 130 is inserted into the free end of the sewer tube 15, wherein the said sealing rings 16 and 17 assure a water-tight seal.

The first exhaust coupling tube 120 has a second end 122, of which the inner diameter corresponds to the inner diameter of the water supply tube 14. In a groove-shaped recess in the inner wall of the second end 122 of the first exhaust coupling tube 120, a sealing ring 123 is accommodated, of which the dimensions may be equal to those of the first sealing ring 16 of the water supply tube 14. Thus, the second end 122 of the first exhaust coupling tube 120 is adapted for receiving the first end 21 of the first coupling tube 20.

The second exhaust coupling tube 130 has a second end 132, of which the inner diameter corresponds to the inner diameter of the sewer tube 15. In a groove-shaped recess in the inner wall of the second end 132 of the second exhaust coupling tube 130, a sealing ring 133 is accommodated, of which the dimensions may be equal to those of the third sealing ring 17 of the sewer tube 17. Thus, the second end 132 of the second exhaust coupling tube 130 is adapted for receiving the first end 31 of the second coupling tube 30.

The toilet bowl 1, with the two coupling tubes 20 and 30 arranged as usual to the inlet tube 6 and the discharge tube 7, respectively, is mounted against the wall 11 with intermediate positioning of the exhaust unit 100, in such a way that the inlet tube 6 and the discharge tube 7 are aligned as usual with the water supply tube 14 and the sewer tube 15, respectively. Further, the first end 21 of the first coupling tube 20 is inserted into the second end 122 of the first exhaust coupling tube 120, and the first end 31 of the second coupling tube 30 is inserted into the second end 132 of the second exhaust coupling tube 130, wherein the said sealing rings 123 and 133 assure a water-tight sealing between the first exhaust coupling tube 120 and the first coupling tube 20 and between the second exhaust coupling tube 130 and the second coupling tube 30, respectively.

In the mounted state, the inlet tube 6 of the toilet bowl 1 is thus connected to the water supply tube 14 through two coupling tubes 20 and 120 in series, and the discharge tube 7 of the toilet bowl 1 is thus connected to the sewer tube 15 through two coupling tubes 30 and 130 in series. It is noted that it is possible that the two ends 122 and 132 of the two first exhaust coupling tubes 120 and 130 may also project outside the house 101, so that they can directly receive the inlet tube 6 and the discharge tube 7, respectively, of the toilet bowl 1, in which case the original coupling tubes 20 and 30 may thus be omitted, but this is not illustrated separately.

In an embodiment, the shape and dimensions of the house 101 are such that the house 101 fits inside the rear edge 5 of the toilet bowl 1. In the mounted state, the house 101 is then fully hidden from view by the toilet bowl 1: the side view is then the same as in FIG. 1. Since in that case the appearance of the exhaust unit does not play a role, the house may be omitted and the connections between the different parts may be implemented in the form of tubes or flexible hoses.

In another embodiment, the house 101 has a shape and dimensions equal to those of the rear edge 5 of the toilet bowl 1, so that in the mounted state, the house 101 may be seen as an extension of the toilet bowl.

In a preferred embodiment, the house 101 is larger than the rear edge 5 of the toilet bowl 1. In that case, the house has a front wall 103, substantially parallel to the rear wall 102, against which the rear edge 5 of the toilet bowl 1 rests. The shape of the house may now, independently of the shape of the toilet bowl, be designed as an aesthetically attractive shape, for example round, rectangular, etc. Further, the house 101 then has more "inner space" for incorporating the elements still to be discussed of the exhaust unit according to the invention.

Figure 5:
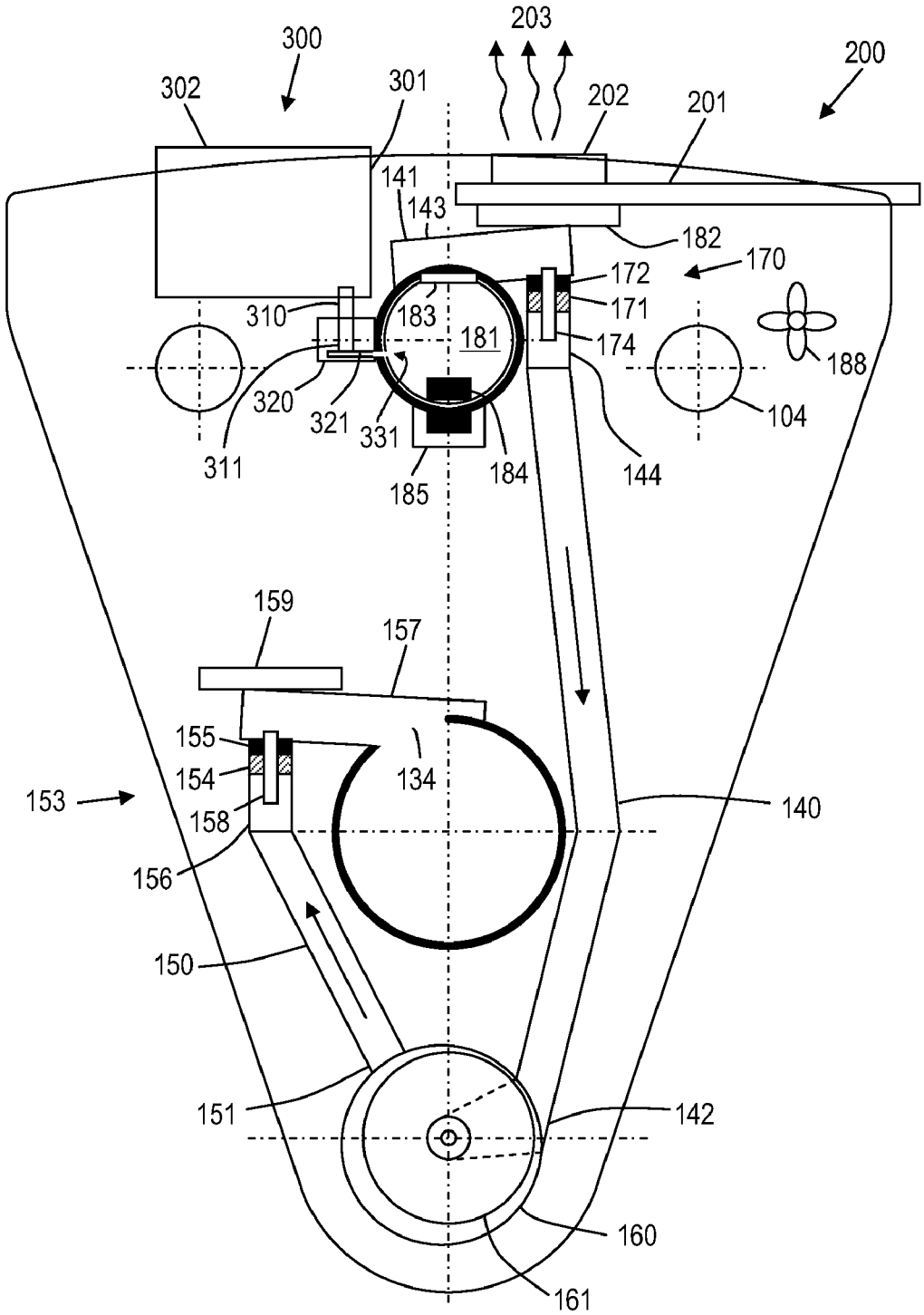

FIG. 5 schematically shows a longitudinal section of the house 101 of the exhaust unit 100 according to the present invention. As mentioned in the preceding, the house 101 may be larger then this shape, but in the embodiment shown, the house 101 has an outer contour that corresponds to the contour of a usual shape of a rear edge of a toilet bowl. Although the house 101 may be made of several materials, it is preferred that the house 101 is made of solid synthetic plate, with recessed spaces, as will be described hereafter.

The house 101 has two holes 104 extending through it, which serve to let pass the usual threaded rods, with which the toilet bowl 1 is fixed to the wall 11.

The house 101 comprises a suction channel 140, a blow channel 150, and a fan room 160 with a fan 161 arranged in it. The fan room 160 is situated under the second exhaust coupling tube 130, for the reason that most toilet bowls under their discharge tube 7 have a hollow space that is large enough to accommodate a sufficiently large fan.

In the upper wall of the first exhaust coupling tube 120, an opening 124 is made, to which an inlet end 141 of the suction channel 140 connects. A discharge end 142 of the suction channel 140 connects to the fan room 160, on the inlet side of the fan 161.

In the upper wall of the second exhaust coupling tube 130 an opening 134 is made, to which a discharge end 152 of the blow channel 150 connects. An inlet end 151 of the blow channel 150 connects to the fan room 160, on the discharge side of the fan 161.

Here, the fan 161 is of a disc-shaped type with a central suction along the centre line and a blow-out along the circumference. Here, the fan room 160 has a circular contour, with a diameter larger than that of the fan 161, and the fan 161 is arranged asymmetrically in the fan room 160, closer to the discharge end 142 of the suction channel 140 than to the inlet end 151 of the blow channel 150, so that the air to be blown out experiences as little resistance as possible.

The fan 161 is connected to a voltage supply, which is not shown in the figures for the sake of simplicity, by means of connecting wires, which are also not shown for the sake of simplicity. The fan 161 may for example be a 12V type, or a 220V type, as will be clear to a person skilled in the art. The fan 161 may constantly be connected to its voltage supply, so that the fan 161 is in operation continuously, or through a switch (not shown), so that the fan 161 may be switched on or off as desired. Such a switch may be a separate switch, but may also be the switch which operates the light in the room 10, or a presence detection switch, so that the fan 161 automatically starts to operate if a user enters the room 10. The fan 161 may be provided with a delay circuit known per se, which has the result that the fan 161 remains operating for some time (for example 5 minutes) after the user has left the room 10.

When the fan 161 is in operation, it sucks air out of the inner space 4 of the toilet bowl 1 through the suction channel 140, the first exhaust coupling tube 120, the coupling tube 20 and the inlet tube 6. The exhausted air is blown into the sewer tube 15 through the blow channel 150 and the second exhaust coupling tube 130. An important aspect of the invention is that, to this end, no adaptations of the standard toilet bowl 1 have been necessary.

When the toilet bowl 1 is flushed clean with water from the water reservoir 13, water could end up in the suction channel 140 and/or the blow channel 150, which is undesired. In order to prevent this, the exhaust unit 100 is preferably provided with some provisions which are shown in FIG. 5 and which will be discussed hereinafter.

In the blow channel 150, a one-way valve 153 is arranged, that is adapted to let an air flow pass from the fan 161 to the second exhaust coupling tube 130 and to stop a water flow in the opposite direction. This one-way valve comprises a valve seat 154 and a valve body 155 which, in a rest condition, rests against the valve seat 154 and closes a passage opening of the valve seat. The valve body 155 can be pressed against the valve seat by a spring body (not shown). In the embodiment shown, the one-way valve 153 is mounted in a substantially vertically directed channel part 156 of the blow channel 150, in which case a separate spring may be left out and, in the rest position, the valve body 155 is kept on the valve seat 154 by gravity.

The one-way valve 153 may be of a passive type which opens by the force of the air flow caused by the fan 161. When the fan 161 is in operation, the air pressure under the one-way valve 153 increases and the valve body 155 is lifted from the valve seat 154: the air to be blown away can now reach the sewer tube 15 through the second exhaust coupling tube 130. When the toilet is flushed and the water level in the second exhaust coupling tube 130 rises and enters the discharge end 152 of the blow channel 150, the pressure of the water is sufficient to press the valve body against the valve seat 154.

In the preferred embodiment shown, however, the one-way valve 153 is of an active type, which can be opened actively. To that end, the one-way valve 153 comprises a magnet or magnetizable body 158 coupled with the valve body 155. Outside the blow channel 150, a first electromagnet 159 is arranged, which can cooperate with the magnetizable body 158. More particularly, when the electromagnet 159 carries current, the electromagnet 159 exerts a force on the magnet or the magnetizable body 158, respectively, larger than, and in a direction opposite to, the force of gravity, so that the valve body 155 is lifted from the valve seat 154. In other words, when the electromagnet 159 is energized, the valve 153 is opened.

In the preferred embodiment shown, the one-way valve 153 is mounted near the highest point of the vertically directed channel part 156 of the blow channel 150, and, between the one-way valve 153 and the opening 134 of the second exhaust coupling tube 130, the blow channel 150 has a channel part 157 that is substantially directed horizontally, or rather descends continuously sloping from the highest point of the vertically directed channel part 156 to the lower situated opening 134 of the second exhaust coupling tube 130. Hereby, it is achieved that any water which has possibly penetrated into the blow channel 150 through the opening 134 of the second exhaust coupling tube 130, automatically flows back to the second exhaust coupling tube 130, aided therein by the air flowing in the same direction, when the water level in the second exhaust coupling tube 130 sinks again.

In the suction channel 140, a valve 170 is arranged that is adapted to let an air flow pass from the first exhaust coupling tube 120 to the fan 161 and to stop a water flow in the same direction. The valve 170 comprises a valve seat 171 and a valve body 172. The valve 170 is provided with operating means 180 which are able to open or close the valve 170, based on whether or not water is present in the first exhaust coupling tube 120. The operating means 180 comprise a water sensor 181 arranged in the first exhaust coupling tube 120, and an actuator 182 operated by the water sensor 181 which operates the valve body 172.

If desired, the valve 170 may be provided with a return spring, in order to press the valve body 172 against the valve seat 171, so that, if no other forces are exerted on the valve body 172, the valve 170 is kept closed by such a return spring.

In the embodiment shown, the valve 170 is mounted in a substantially vertically directed channel part 144 of the suction channel 140, and, in the rest position, the valve body 172 is kept on the valve seat 171 by the gravity. Nevertheless, it may be desired to provide a return spring as described above, which then lends the gravity "a helping hand" and the valve 170 can close faster in occurring cases.

In the embodiment shown, the valve 170 further comprises a magnet or a magnetizable body 174 coupled with the valve body 172. Outside the suction channel 140, a second electromagnet 182 is arranged, that can cooperate with the magnetizable body 174. More particularly, when the second electromagnet 182 carries current, the second electromagnet 182 exerts a force on the magnet or the magnetizable body 174, respectively, in a direction opposite to the gravity and opposite to the return force of the possible return spring, which force exerted by the second electromagnet 182 is larger than the gravity plus the possible return force of the possible return spring, so that the valve body 172 is lifted from the valve seat 171. In other words, when the electromagnet 182 is energized, the valve 170 is opened.

Figure 6:
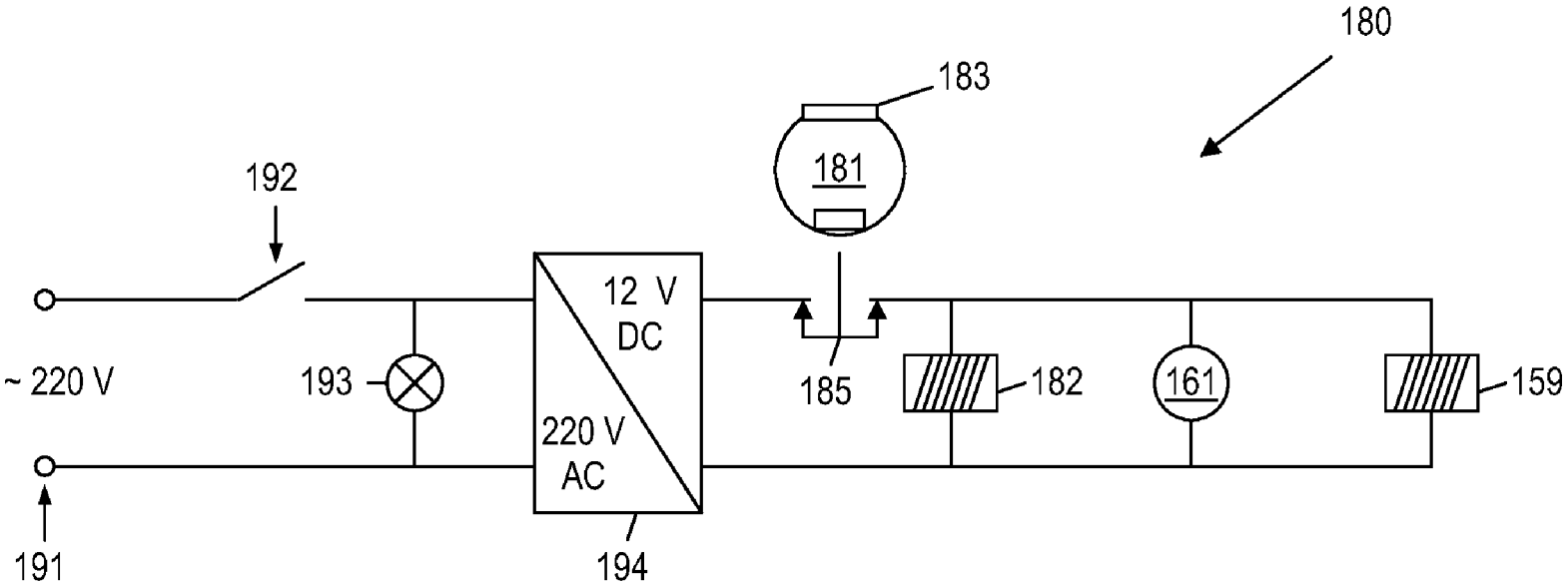
FIG. 6 shows an electrical connection circuit.

In the embodiment shown, the water sensor 181 comprises a plate 181 arranged inside the first exhaust coupling tube 120, which plate, at its upper end, is connected pivotably to the upper wall of the first exhaust coupling tube 120, the pivot axis 183 being directed substantially perpendicular to the centre line of the first exhaust coupling tube 120. Preferably, and as shown, this sensor plate 181 is situated between the inlet end 121 of the first exhaust coupling tube 120 and the opening 124 in the upper wall of the first exhaust coupling tube 120. A magnet 184 is attached to the lower end of the sensor plate 181. Under the first exhaust coupling tube 120, a magnet switch 185 is mounted, that is operated by the magnet 184. The magnet switch 185 is incorporated in the supply circuit for the electromagnet 182, which electromagnet 182 may be connected in parallel with the fan 161, as schematically shown in the block diagram of FIG. 6.

For safety reasons, the fan 161 and the electromagnet 182 preferably are low voltage devices, for example adapted to be supplied with 12 V DC. Although it is possible to supply these devices from an accumulator or battery, it is more convenient to obtain the supply from the mains 191 (220 V AC). Although the devices may be operated with a separate switch, it is more convenient to operate these devices with the switch 192 which also operates the lamp 193 in the room 10. With its input, a converter 194 is connected to the output of the switch 192, parallel to the lamp 193. An output of the converter 194, which may be a converter known per se and will therefore not be explained further, is connected to a parallel circuit of the fan 161, the first electromagnet 159 and the second electromagnet 182, the magnet switch 185 being connected in series with this parallel circuit.

The functioning is as follows. At rest, the sensor plate 181 is situated in a vertical position, so that the magnet 184 attached to it is located in the vicinity of the magnet switch 185, which is therefore closed. When a user now enters the room 10 and operates the light switch 192, the light 193 starts burning, and the converter 194 starts to supply output voltage, so that the fan 161 starts to rotate and the two electromagnets 159 and 182 open the respective valves 153 and 170. So the two valves are always opened when the fan rotates. The fan 161 then sucks air through the first exhaust coupling tube 120.

The sensor plate 181 impedes an air flow from the water reservoir 13, so that the fan 161 mainly sucks air from the interior 4 of the toilet bowl 1.

When the user flushes the toilet, water flows with large force from the water reservoir 13 through the first exhaust coupling tube 120. Hereby, the sensor plate 181 is pushed out of its vertical position to a virtually horizontal position. In this horizontal position, the sensor plate 181 largely covers the opening 124 in the upper wall of the first exhaust coupling tube, whereby penetrating of flushing water into the suction tube 140 is counteracted. Moreover, the magnet 184 is now at distance from the magnet switch 185, which is therefore opened, so that the fan 161 stops and the two electromagnets 159 and 182 release the respective valves 153 and 170, so that the valves 153 and 170 are closed. Possible return springs will be able to accelerate closing of the valves 153 and 170. When the water reservoir 13 has emptied and the water level in the first exhaust coupling tube 120 has dropped sufficiently, the sensor plate 181 returns to its vertical position whereby the magnet switch 185 closes again and the fan 161 and the two electromagnets 159 and 182 are energized again.

In principle, the location of the valve 170 is not critical, neither is the location of the electromagnet 182. Depending on the dimensions of the house 101, there is however more or less space for accommodating these parts. Moreover, it is preferred that the channel part between the opening 124 in the upper wall of the first exhaust coupling tube 120 and the valve 170 is an inclining channel part, with possibly a horizontal part, so that water which penetrates the suction channel 140 when the user flushes the toilet automatically flows back from the suction channel 140 to the first exhaust coupling tube 120 when the water flow from the water reservoir 13 has stopped.

In the embodiment shown, the suction channel 140 has, adjacent to the inlet end 141, a first channel part 143 that inclines somewhat from the inlet end 141, although a horizontal orientation would also be allowable. The first channel part 143 continues into a second, substantially vertically directed channel part 144 which connects to the fan room 160.

In this embodiment shown, the valve 170 is mounted in the entrance of the second channel part 144, wherein the magnetizable body 174 extends in the second channel part 144 and the electromagnet 182 is arranged in line with the second channel part 144.

In a preferred embodiment, an air refreshener unit 200 is integrated in the house 101. The air refreshener unit 200 comprises a reservoir 201 filled with a pleasantly smelling substance, for example based on essential oil. Advantageously, the reservoir 201 is implemented in the form of an exchangeable cassette. In its upper wall, above the electromagnet 182, the house 101 is provided with a grate 202 for letting smells 203 originating from the reservoir 201 pass. The reservoir 201 is situated under the grate 202, in the vicinity of the electromagnet 182, and is heated by the heat produced in the electromagnet 182 during the operation thereof, whereby the smelling vapours are released. Advantageously, the reservoir 201 is situated above the electromagnet 182.

Thus, useful use is made of the heat produced in the electromagnet 182, which would otherwise only involve energetic loss, while further fully automatically a pleasant smell is released into the room 10, which masks the unpleasant smells that possibly escape from the exhaust system.

If desired, the air refreshener unit 200 may be provided with a fan 188, that may be connected in parallel with the electromagnet 182. Such a fan may be arranged in such a way that it blows air along the electromagnet 182 whereby it is cooled, and in such a way that air is blown from the reservoir 201 to the grate 202, so that the smells released from the reservoir 201 better reach the room 10. Thus, such a fan has a double function, that of cooling of the electromagnet 182 and that of forcing outward the smells 203 originating from the reservoir 201.

A further aspect of the present invention relates to a device for releasing a cleaning fluid to flushing water in a dosed way. For this purpose, containers are known that are hung on the edge of the toilet bowl, and that contain the fluid concerned. Each time the toilet is flushed, the flushing water flushes along openings of the container and takes along some of this fluid. The fluid, usually a viscous fluid or gel, has a disinfecting function, and/or prevents lime scale, and/or produces a pleasant smell. Disadvantage of the known containers is the fact that they release the fluid in a toilet bowl very locally. After a flush, these containers have the tendency still to drip for some time, wherein the dripping water also contains the fluid, which has the result that from the container a trail of coloured liquid, usually coloured blue, yellow or green, runs to the water surface in the toilet bowl. Further, it is a disadvantage that the fluid does reach the part of the interior of the toilet bowl where the container is hung up, but the fluid does not or hardly reach the opposite part of the toilet bowl.

Further, it is a disadvantage of the known containers that one always has to get with one's hands into the interior 4 of the toilet bowl 1 in order to place, fill or replace a container, which is undesired from a hygienic point of view, and the chance of leaking coloured fluid on the floor is large. Further, when one wants to clean the interior 4 of the toilet bowl 1, the container is in the way, so that it is not well possible to reach the interior 4 of the toilet bowl 1 well, which is a disadvantage from a hygienic point of view. If one would now take away the container in order to clean the interior 4 of the toilet bowl 1 well, then the chance is large that coloured fluid leaks out of the container that is still partially filled.

Further, it is a disadvantage of known containers that there is a risk that one drops the container in the toilet bowl while taking away or placing: the container is then at the bottom of the bowl, and has to be fished up by hand.

Further, it is a disadvantage of known containers, that playing children may take the container away and put it in their mouth.

An object of this aspect of the invention is to solve or at least to reduce these problems.

To that end, the present invention provides a container for cleaning fluid, which container has a dispense opening that is connected to the water supply tube from the flushing water reservoir to the toilet bowl. Although such a container may be connected separately at any position of the water supply tube, the container of the invention is preferably integrated in the house 101 of an exhaust unit 100 according to the present invention, as also shown in FIG. 5.

FIG. 5 illustrates a container 300 for cleaning fluid mounted in a recess 301 of the house 101. The container 300 is preferably implemented as an exchangeable cassette, but may also be implemented as a fixedly mounted reservoir, in which case that reservoir will be provided with a filling opening. The container 300 is mounted in such a way that a wall part 302 thereof (in this case the upper wall) is visible from the outside for a user. If desired, a cover lid may be provided in order to hide the container from view. The container 300, at least a part of that visible wall 302, is preferably implemented transparently, so that the fluid level in the container 300 is observable from the outside. It is also possible that an electronic monitoring system for the amount of fluid is provided. A sensor measures the amount of fluid in the container. A light source (lamp, LED) indicates the state. For example, a burning lamp may indicate that the fluid level is low. It is also possible to apply a three-colour indication: a green light indicates that the fluid level is sufficient, a yellow or orange light indicates that fluid has to be filled shortly, and a red light indicates that the fluid is (almost) used up. In that case, it is not necessary that the container is mounted visibly.

The container 300 has a tube-shaped dispense channel 310, for example in the form of a pipe or hose (of which the diameter may be approximately 8 mm), of which the discharge end 311 is connected fluid-tightly to a passage opening 331 in the wall of the first exhaust coupling tube 120. In the preferred embodiment shown, a dose measuring block 320 is arranged against the side wall of the first exhaust coupling tube 120, for example by gluing. The dose measuring block 320 has an interior space 321, which on the one hand communicates to the dispense channel 310 of the container 300, and which on the other hand communicates to the passage opening 331 which is implemented as a capillary opening. The interior space 321 of the dose measuring block 320 may also be implemented as capillary space.

The functioning is as follows. In a rest state, the interior space 321 of the dose measuring block 321 is filled with the cleaning fluid, and the capillary passage opening 331 sucks itself full with the cleaning fluid. When a user flushes the toilet 1, the first exhaust coupling tube 120 fills itself with fast-flowing flushing water flowing along the capillary passage opening 331 and, by doing so, taking along cleaning fluid from that passage opening 331. After the flush, the water drops, and air can reach the interior of the container 300 through the capillary passage opening 331 and through the tube-shaped dispense channel 310, so that the interior space 321 of the dose measuring block 320 and the capillary passage opening 331 can fill themselves again with the cleaning fluid. In order to facilitate air to flow back through the capillary passage opening 331, this capillary passage opening 331 is preferably a gap-shaped passage opening. The capillary passage opening 331 is dimensioned in such a way, that the container 300 is prevented from running empty. Only when water flows along the capillary passage opening 331, cleaning fluid is sucked out of it.

An important advantage thus achieved according to the present invention is that the cleaning fluid is added to the flushing water before the flushing water flows into the inner space 4 of the toilet bowl 1, so that the cleaning fluid is distributed well over the whole toilet bowl, and even reaches the internal distribution channels and discharge channels of the toilet bowl. Further, a user does not have to remove or place a container in the interior 4 of the toilet bowl 1 for replacing or filling a container, and also the container is not in the way when the interior 4 of the toilet bowl 1 is cleaned.

Figure 7A:
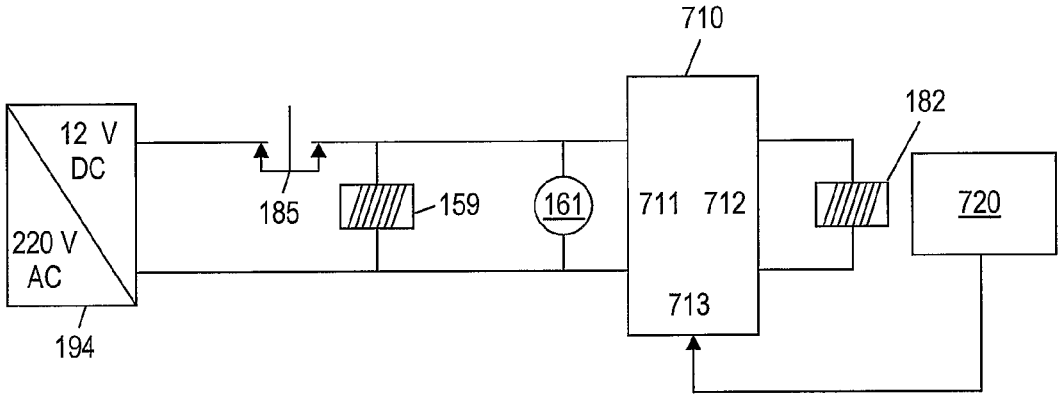
FIG. 7A is a block diagram schematically illustrating a temperature control circuit.
Figure 7B:
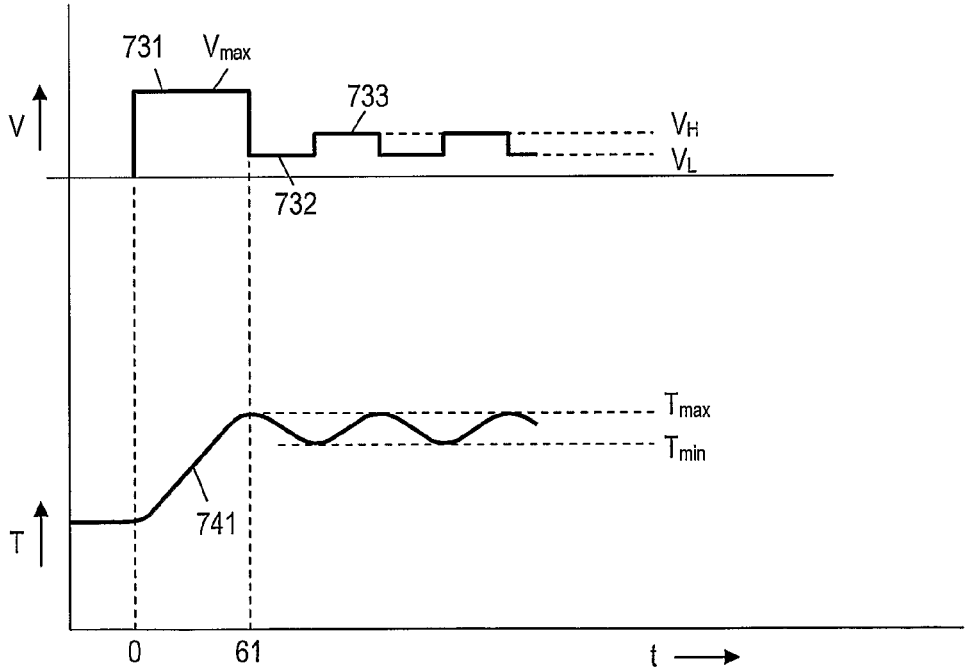
FIG. 7B is a graph schematically illustrating the functioning of the temperature control circuit of FIG. 7A.

In the preceding, it has been described that the air refreshener unit 200 is provided with a heating member, which role is advantageously fulfilled by the electromagnet 182. In that case, it is preferred to provide a temperature control for this electromagnet. Such a control is illustrated in the block diagram of FIG. 7A; the functioning is illustrated in the graph of FIG. 7B.

Instead of the electromagnet 182 being directly (through the switch 185) connected to the output of the converter 194, the electromagnet 182 is provided with a control member 710, of which a supply input 711 is connected in parallel with the fan 161. Alternatively, the control member 710 may be connected to a continuous voltage source, and a command input may be connected in parallel with the fan 161. The control member 710 has an output 712, to which the electromagnet 182 is connected. The electromagnet 182 is further provided with a thermo-sensor 720, for example an NTC-resistor or the like, that is connected to a signal input 713 of the control member 710. The control member 710, on energizing, is adapted to first offer a relatively high output voltage to the electromagnet 182 for a predetermined time t1 (for example approximately 10 sec), as illustrated by the part 731 of the voltage curve shown in FIG. 7B, in order to assure that it exerts a relatively large force to open the lid 170. As a result of the current flowing through the electromagnet 182, it will warm up fairly fast, as illustrated by the part 741 of the temperature curve shown in FIG. 7B.

After passing of this predetermined time t1, the control member 710 enters a temperature control mode, in which the control member 710 supplies its output voltage depending on the temperature signal received from the thermo-sensor 720. When the temperature signal received from the thermo-sensor 720 indicates that the temperature of the electromagnet 182 has reached a highest predetermined level Tmax, the control member 710 supplies its output voltage at a low control value VL, as indicated by the part 732 of the voltage curve shown in FIG. 7B, which value is sufficiently high to maintain the valve 170 opened, but is low enough to let the electromagnet 182 cool down. When the temperature signal received from the thermo-sensor 720 indicates that the temperature of the electromagnet 182 has dropped to a lowest predetermined level Tmin, the control member 710 supplies its output voltage at a high control value VH, as indicated by the part 733 of the voltage curve shown in FIG. 7B, which value is sufficiently high to heat the electromagnet 182 again. Thus, the valve 170 will always remain opened, while the temperature of the electromagnet 182 is still controlled at an average value between the two said levels Tmin and Tmax, which average value is a suitable operating temperature for the electromagnet 182 which is chosen in relation to a good functioning of the air refreshener unit 200. In an exemplary embodiment, this average temperature amounts to approximately 50° C.

Figure 8:
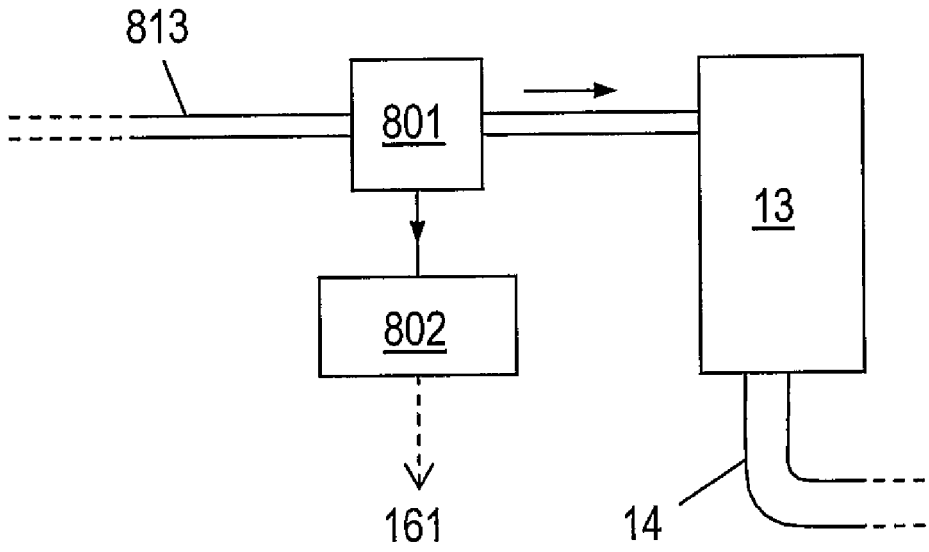
FIG. 8 is a block diagram schematically illustrating the application of a water-driven generator.

In the preceding, it has been mentioned that the fan 161 may be supplied from the lighting mains, and may for example be connected in parallel with the lighting in the room 10. In practice, this may pose a problem if it is not easy to bring the required supply wires to the back side of the wall 11. In a possible embodiment, the exhaust unit of the present invention is provided with its own voltage source in the form of a rechargeable battery or accumulator 802, supplied by a water-driven generator 801 mounted in the water supply pipe 813 of the water reservoir 13, as illustrated in the block diagram of FIG. 8. The generator 801 comprises a turbine wheel or the like coupled with a dynamo. After each flush, the water reservoir 13 is refilled. The water from the water supply pipe 813 drives the generator 801, so that the accumulator 802 is charged. The accumulator 802 supplies the fan 161, and energizes the valves 170 and 153.

For switching the fan 161 on or off, a separate switch may be present, to be operated by the user, as has already been mentioned in the preceding. In a preferred embodiment, the unit 100 is provided with a sensor 820 that detects if a user is going to sit on the toilet bowl. Such a sensor may be a pressure-sensitive sensor, that may be mounted in the house 101, at the position where the lower edge 5 of the toilet bowl 1 supports against the front wall 103 of the house 101, as shown in FIG. 3. The pressure-sensitive sensor 820 may for example comprise one or more strain gauges, as will be clear to a person skilled in the art.

It will be clear to a person skilled in the art that the invention is not limited to the exemplary embodiments discussed in the preceding, but that several variations and modifications are possible within the protective scope of the invention as defined in the attached claims. For example, it is possible that the one-way valve 153 in the blow channel 150 is an active valve.

Further, it is possible to detect the flowing of water in the first exhaust coupling tube 120 with other detection means than the described means, and/or the valve 170 and the associated operating means may be constructed differently.

Further, it is possible that the grate 202 is situated in the front wall of the house 101, in the case that the house 101 is larger than the edge 5 of the toilet bowl 1.

Further, it is possible that the air refreshener unit 200 is provided with a separate heating member.

The valves 153 and 170 discussed in the preceding by way of example each have a valve body and valve seat arranged in the pipe concerned. For increasing the reliability, it is preferred that the moving parts of the valves are situated outside the pipe concerned. In a preferred embodiment, at least one of those valves, more preferably both, is therefore implemented as a flexible hose part provided with pinching means to pinch the hose closed. FIG. 9A schematically illustrates an example of such a valve 910. Beside a flexible hose 911, a pinching cam 912 is arranged, mounted to an arm 913 that is pivotable around a hinge 914. The pinching cam 912 may be fixed to the arm 913, but preferably the pinching cam 912 is implemented as a wheel which is rotatably attached to the arm 913. An actuator 915 operates the arm 913. To the left in FIG. 9A, the arm 913 is held by the actuator 915 in a position wherein the pinching cam 912 leaves the hose 911 completely free: the valve is open. To the right in FIG. 9A, the arm 913 is held by the actuator 915 in a position wherein the pinching cam 912 presses the hose 911 completely closed: the valve is closed.

The valve 910 may have a one-way character. In the right half of FIG. 9A, it can be seen that the pinching cam 912 can be pushed away, so that the hose 911 opens if fluid or air flows in the hose from the right, while, if fluid or air flows in the hose from the left, the pinching cam 912 is pressed further closed.

A suitable material for the flexible hose 911 is silicon rubber.

In the preceding, it has been discussed that the cleaning fluid is brought to the exhaust coupling tube 120 through a capillary channel, in order thus to be taken along by the water flowing along. However, it may be desired to better dose the amount of cleaning fluid to be dispensed. To that end, use can be made of an injector. Because here it is also preferred that the moving parts do not come into contact with the cleaning fluid, preferably use is made of a displacement pump, as schematically illustrated in FIG. 9B.

FIG. 9B schematically shows that from the bottom side of the container 300 a flexible hose 920 goes to the exhaust coupling tube 120, along a displacement pump 921. When flushing water flows through the exhaust coupling tube 120, as for example detected by the sensor 181, the displacement pump 921 is energized in order to rotate with a particular speed and over a particular distance. Hereby, it is possible to precisely dose how much cleaning fluid is added to the flushing water. Since displacement pumps are known per se, a more extensive discussion of the functioning thereof is not necessary here. It is noted that the hose 920 does not need to be flexible over its entire length; it suffices if the part that cooperates with the displacement pump 921 is flexible.

In the preceding, the present invention has been described for an embodiment intended to be applied in existing situations. The exhaust unit is then simple to position by taking away an existing toilet bowl, installing the exhaust unit, and repositioning the toilet bowl again (or replacing it by another one, if desired). In that case, the exhaust unit 100 will thus be positioned with its back wall 102 against a wall 11 and with its front wall 103 in contact with the toilet bowl 1 concerned. It is also possible that the present invention is implemented in an embodiment intended for positioning behind the wall, for example in renovation works. In that case, the exhaust unit 100 will thus be positioned with its front wall 103 against the back side of a wall 11, i.e. that side of the wall which is directed away from the toilet bowl. Then, the unit 100 is not visible from the toilet room 10. For filling the cleaning fluid and the air refreshener fluid, special connections will then be necessary, but they may be concealed behind a service hatch (not shown in the figures).

In a particular embodiment variation, the present invention is integrated in a rinsing unit for wall build-in. Such flushing units, which are known per se, comprise a frame with a flushing water reservoir in it, connections for a toilet bowl, and connections for water supply and sewer. After positioning of such a flushing unit, a secondary wall is placed, which then has the function of the wall 11 discussed in the preceding, and then the toilet bowl 1 is connected.

FIG. 10 schematically shows a front view of a flushing unit 1000 that is adapted according to the present invention. The flushing unit 1000 has a frame 1001 for attaching to a wall and/or to a floor. A flushing water reservoir 1010 is mounted in the frame; the flushing water in the reservoir is indicated with 1011. From the flushing water reservoir 1010, a flushing pipe 1012 extends downward, ending in a connecting sleeve 1014, similar to tube 14 of FIG. 2A. Further, a second connecting sleeve 1015 positioned under the first connecting sleeve 1014 is provided, similar to tube 15 of FIG. 2A. When the flushing unit 1000 is positioned, the second connecting sleeve 1015 is connected to the sewer (not shown); further, the flushing water reservoir 1010 is connected to a water supply (not shown). After positioning the flushing unit 1000, a toilet bowl 1 is connected to the two connecting sleeves 1014 and 1015.

A cover plate 1016 closes a service opening in the side wall of the flushing water reservoir 1010.

According to the present invention, the flushing unit 1000 is provided with exhaust means 1020 for exhausting undesired gases from the toilet bowl and blowing them away to the sewer. Those exhaust means 1020 comprise air suction and blow means 1021 that may be identical to the means 161 discussed in the preceding, and which will hereinafter simply be indicated as fan. A suction channel 1022 extends from an opening in the wall of the second connecting sleeve 1015 to the fan 1021. A blow channel 1023 extends from the fan 1021 to the internal space of the flushing water reservoir 1010, wherein the free end of the blow channel 1023 is situated near the upper wall of the flushing water reservoir 1010, at least well above the highest level of the flushing water 1011. In the sketch of FIG. 10, the blow channel 1023 is drawn as extending through the bottom of the flushing water reservoir 1010, but preferably, the blow channel 1023 goes along the flushing water reservoir 1010 in order to connect to an opening in the side wall or even upper wall thereof.

Thus, it is not necessary that the blow channel 1023 is connected to an opening in the first connecting sleeve 1014, because the flushing water reservoir 1010 normally communicates to the first connecting sleeve 1014 through the flushing pipe 1012.

Preferably, an air refreshener unit 1200 is provided. This unit comprises a reservoir 1201 filled with a pleasantly smelling substance. The reservoir 1201 may for example be attached to the frame 1000, or for example to the flushing water reservoir 1010. The reservoir 1201 may be implemented as an exchangeable cassette, or as a fixed reservoir with a filling tube 1202 of which the free end is for example accessible through the cover plate 1016. For functioning of the air refreshener unit 1200, especially heating of the substance by heating means 1205, the same applies as discussed in relation to the air refreshener unit 200, so this does not need to be repeated here. It suffices to note that the air refreshener unit 1200 may be provided with a light indication 1203 for the amount of substance in the reservoir 1201, which light indication 1203 may be arranged on the cover plate 1016.

Preferably, a cleaning unit 1300 is provided. This unit comprises a reservoir 1301 filled with a cleaning fluid. The reservoir 1301 may for example be attached to the frame 1000, or for example to the flushing water reservoir 1010. The reservoir 1301 may be implemented as an exchangeable cassette, or as a fixed reservoir with a filling tube 1302 of which the free end is for example accessible through the cover plate 1016.

Through a dispense channel 1310, the reservoir 1301 is connected water-tightly to an opening in the wall of the first connecting sleeve 1014. For a good and reproducible dosing, this dispense channel 1310 is at least partly implemented as a flexible hose and provided with a displacement pump 1320.

For the functioning of the cleaning unit 1300, the same applies as discussed in relation to the cleaning unit 300, so this does not need to be repeated here. It suffices to note that the cleaning unit 1300 may be provided with a light indication 1303 for the amount of cleaning fluid in the reservoir 1301, which light indication 1303 may be arranged on the cover plate 1016.

Finally, it is noted that an air refreshener unit 1200 or 200 as discussed in the preceding may be applied independently of the presence or absence of an exhaust system. The same applies to a cleaning unit 1300 or 300.

The invention claimed is:

1. Exhaust unit for a hanging toilet bowl, comprising:

a house with a back wall and a front wall substantially parallel to the back wall;

a first exhaust coupling tube extending in the house from the front wall to the back wall and having a first end projecting outside the house back wall;

a second exhaust coupling tube extending in the house from the front wall to the back wall and having a first end projecting outside the house back wall;

an opening made in an upper wall of the first exhaust coupling tube;

an opening made in a wall of the second exhaust coupling tube;

air suction and blow means;

a suction channel extending from the opening in the wall of the first exhaust coupling tube to the air suction and blow means;

a blow channel extending from the air suction and blow means to the opening in the wall of the second exhaust coupling tube, the blow channel provided with a blow channel valve being an operable valve adapted to let pass an air flow in the direction from the air suction and blow means to the second exhaust coupling tube but to block a water flow in the opposite direction; and operating means adapted to open or close the blow channel valve in dependence of the presence of water in the first exhaust coupling tube;

wherein a center line of the second exhaust coupling tube is directed substantially parallel to a center line of the first exhaust coupling tube;

wherein the first end of the second exhaust coupling tube has a diameter that is larger than the diameter of the first end of the first exhaust coupling tube;

wherein the house has a mounting position wherein the back wall and the front wall are directed vertically and wherein the first exhaust coupling tube is situated vertically above the second exhaust coupling tube;

wherein, at its second end situated opposite the first end, the first exhaust coupling tube is provided with a sealing ring arranged in a groove-shaped recess of the inner wall; and wherein, at its second end situated opposite the first end, the second exhaust coupling tube is provided with a sealing ring arranged in a groove-shaped recess of the inner wall.

2. Exhaust unit according to claim 1, wherein the air suction and blow means comprise a fan arranged in a fan space of the house.

3. Exhaust unit according to claim 1, wherein the blow channel valve is a valve functioning based on gravity, arranged in a substantially vertically directed channel part of the blow channel.

4. Exhaust unit according to claim 1, wherein the operating means comprise:

a water sensor arranged in the first exhaust coupling tube;

and an actuator operated by the water sensor.

5. Exhaust unit according to claim 4, wherein the blow channel valve comprises:

a valve seat;

and a valve body operated by the actuator.

6. Exhaust unit according to claim 5, wherein the valve body is coupled to a magnet or magnetizable body;

and wherein the actuator comprises an electromagnet.

7. Exhaust unit according to claim 6, wherein the electromagnet is connected in parallel to the air suction and blow means.

8. Exhaust unit according to claim 1, wherein the blow channel valve comprises a flexible pipe part, as well as pinching means for pinching the flexible pipe part.

9. Exhaust unit according to claim 1, wherein the suction channel is provided with a suction channel valve that is adapted to let pass an air flow from the first exhaust coupling tube to the air suction and blow means and to stop a water flow in the same direction.

10. Exhaust unit according to claim 9, wherein the suction channel valve comprises a flexible pipe part, as well as pinching means for pinching the flexible part.

11. Exhaust unit according to claim 9, wherein the suction channel valve is an operable valve;

and wherein the exhaust unit is provided with operating means adapted to open or close the suction channel valve in dependence of the presence of water in the first exhaust coupling tube.

12. Exhaust unit according to claim 11, wherein the operating means comprise:

a water sensor arranged in the first exhaust coupling tube;

and an actuator operated by the water sensor.

13. Exhaust unit according to claim 12, wherein the suction channel valve comprises:

a valve seat;

and a valve body operated by the actuator.

14. Exhaust unit according to claim 13, wherein the valve body is coupled to a magnet or magnetizable body;

and wherein the actuator comprises an electromagnet.

15. Exhaust unit according to claim 14, wherein the electromagnet is connected in parallel to the air suction and blow means.

16. Exhaust unit according to claim 14, further provided with an air refreshener unit integrated in the house, comprising a reservoir filled with a pleasantly smelling substance, wherein the electromagnet is coupled thermally to the reservoir.

17. Exhaust unit according to claim 16, wherein the electromagnet is connected to an output of an control member, of which an input is connected in parallel to the air suction and blow means, which control member has a signal input that is coupled to a thermo-sensor, that is coupled thermally to the electromagnet.

18. Exhaust unit according to claim 17, wherein, in a temperature control mode, the control member is adapted to supply its output voltage in dependence of the temperature signal received from the thermo-sensor in such a way that the suction channel valve always remains opened while the temperature of the electromagnet is controlled at a predetermined average value.

19. Exhaust unit according to claim 18, wherein, on energizing, the control member is adapted to first supply a relatively high output voltage to the electromagnet during a predetermined time t1.

20. Exhaust unit according to claim 16, further provided with a fan adapted to blow air along the reservoir.

21. Exhaust unit according to claim 20, wherein the fan is connected electrically in parallel to the electromagnet.

22. Exhaust unit according to claim 20, wherein the fan also is adapted to blow air along the electromagnet.

23. Exhaust unit according to claim 13, wherein the valve body is coupled to a return spring that is adapted to bias the valve body to the closed state of the suction channel valve;

and wherein the actuator, on energizing, is adapted to displace the valve body, against the force of the return spring, in order to open the suction channel valve.

24. Exhaust unit according to claim 12, wherein the water sensor comprises a sensor plate arranged inside the first exhaust coupling tube, which sensor plate, at its upper end, is attached pivotably to the upper wall of the first exhaust coupling tube, wherein the pivot axis is substantially directed perpendicular to the center line of the first exhaust coupling tube.

25. Exhaust unit according to claim 24, wherein the sensor plate is situated between the inlet end of the first exhaust coupling tube and the opening in the upper wall of the first exhaust coupling tube.

26. Exhaust unit according to claim 24, wherein a magnet is attached to the bottom end of the sensor plate, and wherein a magnet switch operated by the magnet is mounted under the first exhaust coupling tube.

27. Exhaust unit according to claim 26, wherein the magnet switch is incorporated in a supply circuit for the actuator.

28. Exhaust unit according to claim 9, wherein a channel part of the suction channel situated between the suction channel valve and the opening in the upper wall of the first exhaust coupling tube drains away to this opening.

29. Exhaust unit according to claim 1, further provided with an air refreshener unit integrated in the house, comprising a reservoir filled with a pleasantly smelling substance, and heating means for heating the reservoir.

30. Exhaust unit according to claim 29, wherein the heating means are connected electrically in parallel to the air suction and blow means.

31. Exhaust unit according to claim 29, further provided with a fan adapted to blow air along the reservoir.

32. Exhaust unit according to claim 31, wherein the fan is connected electrically in parallel to the heating means.

33. Exhaust unit according to claim 31, wherein the fan also is adapted to blow air along the heating means.

34. Exhaust unit according to claim 1, further comprising:

a container for cleaning fluid mounted in the house, which container is provided with an exit that communicates to a passage opening in the wall of the first exhaust coupling tube.

35. Exhaust unit according to claim 34, wherein the passage opening is a capillary passage opening.

36. Exhaust unit according to claim 34, wherein the container has a wall part that is visible from the outside.

37. Exhaust unit according to claim 36, wherein the container has a wall part that is at least partly transparent.

38. Exhaust unit according to claim 34, wherein the container is connected to the first exhaust coupling tube through a hose and a displacement pump.

39. Exhaust unit according to claim 1, further comprising:

a rechargeable battery or accumulator for supplying the air suction and blow means;

a water-driven generator intended for mounting in a water supply pipe of a water reservoir, for charging the rechargeable battery or accumulator.

40. Exhaust unit according to claim 1, further comprising:

a pressure-sensitive sensor mounted in the house, sensitive to pressure exerted by the lower rear edge of a toilet bowl to be positioned against the house.

* * * * *